US009888747B2

(12) United States Patent
Smith

(10) Patent No.: US 9,888,747 B2
(45) Date of Patent: Feb. 13, 2018

(54) ZIP FASTENER

(71) Applicant: J&P COATS LTD, Middlesex (GB)

(72) Inventor: Steven Smith, County Durham (GB)

(73) Assignee: J & P COATS LIMITED, Middlesex (GB)

( * ) Notice: Subject to any disclaimer, the term of this patent is extended or adjusted under 35 U.S.C. 154(b) by 0 days.

(21) Appl. No.: 14/750,472

(22) Filed: Jun. 25, 2015

(65) Prior Publication Data

US 2015/0374075 A1 Dec. 31, 2015

(51) Int. Cl.

*A44B 19/30* (2006.01)
*A44B 19/26* (2006.01)
*A44B 19/36* (2006.01)

(52) U.S. Cl.

CPC ..... *A44B 19/30* (2013.01); *A44B 19/26* (2013.01); *A44B 19/262* (2013.01); *A44B 19/36* (2013.01)

(58) Field of Classification Search

CPC ..... A44B 19/26; A44B 19/262; A44B 19/30; A44B 19/36

See application file for complete search history.

(56) References Cited

U.S. PATENT DOCUMENTS 3,319,743 A * 5/1967 Pelavin ..... A44B 19/301 190/120
3,914,827 A * 10/1975 Brown ..... A44B 19/32 24/389
4,015,457 A * 4/1977 Fukuroi ..... A44B 19/301 24/386
4,081,882 A * 4/1978 Toepelt ..... A44B 19/301 24/386
4,251,582 A * 2/1981 Bernier ..... A44B 19/26 148/251
4,350,375 A * 9/1982 Bako ..... A44B 19/301 24/386
4,395,891 A * 8/1983 Remington ..... A44B 19/301 70/68

(Continued)

FOREIGN PATENT DOCUMENTS

EP 2 100 532 A1 9/2009
WO 2010/105297 A1 9/2010

OTHER PUBLICATIONS

Oct. 21, 2015 Search Report issued in European Patent Application No. 15 001 853.9.

*Primary Examiner* — Robert Sandy
*Assistant Examiner* — David M Upchurch
(74) *Attorney, Agent, or Firm* — Oliff PLC

(57) ABSTRACT

A zip fastener comprises two opposing and mutually engageable rows of zip teeth each being mounted upon a respective stringer tape; first and second sliders movably mounted upon the teeth, each slider being movable forward along the teeth to cause interdigitation of the teeth thereby to fasten the zip and backwards to cause extradigitation and unfastening of the zip, the sliders being mounted on the teeth in opposing directions such that motion of the sliders towards and away from each other results in the same action (e.g. fastening or unfastening) on the zip teeth; a docking member, mounted upon the teeth and being movable along the teeth, the docking member being mounted between the two sliders; and each slider being engageable with the docking member thereby to fasten the zip.

8 Claims, 6 Drawing Sheets

(56) References Cited

U.S. PATENT DOCUMENTS 4,512,599 A * 4/1985 De Lima Castro Netto ..... A44B 19/301 24/388
4,514,884 A * 5/1985 Kaneko ..... A44B 19/301 190/120
4,691,540 A * 9/1987 Murase ..... A44B 19/301 70/68
4,976,120 A * 12/1990 Terada ..... A44B 19/301 70/312
5,031,944 A * 7/1991 Keyaki ..... A44B 19/301 24/387
5,103,657 A * 4/1992 Horita ..... A44B 19/301 70/312
5,621,954 A * 4/1997 Mizuno ..... A44B 19/26 24/387
6,062,051 A * 5/2000 Nam ..... A44B 19/301 70/312
6,308,541 B1 * 10/2001 Stowe ..... A44B 19/301 70/312
6,510,593 B1 * 1/2003 Kim ..... A44B 19/301 24/382
6,948,848 B2 * 9/2005 Ausnit ..... B65D 33/2591 24/399
7,073,233 B2 * 7/2006 Leva ..... A44B 19/26 24/386
D526,931 S * 8/2006 Koenig ..... D11/221
7,204,001 B2 * 4/2007 Lin ..... A44B 19/262 24/429
7,506,417 B2 * 3/2009 Yoneoka ..... A44B 19/301 24/386
7,516,523 B2 * 4/2009 Okot ..... A44B 19/262 24/382
7,979,964 B2 * 7/2011 Jans ..... A44B 19/301 24/386
2007/0113384 A1 * 5/2007 Ortlieb ..... A44B 19/26 24/385

* cited by examiner

ZIP FASTENER

BACKGROUND OF THE INVENTION

1. Field of the Invention

The present invention relates to a zip fastener or 'zip' which may, for example, be used in circumstances where it is desired to fasten panels of fabric performing a sealing function to each other. In such circumstances, it is naturally desirable for the zip fastening the panels not to compromise the integrity of the seal.

2. Description of Related Art

One example of such an application is the use of a zip to fasten seat covers; another is the use of a zip to fasten a cover over a mattress where, for example, it is desired to use cover to seal the mattress against infestation by bed bugs.

SUMMARY OF THE INVENTION

The present invention relates to a zip fastener or 'zip' which may, for example, be used in circumstances where it is desired to fasten panels of fabric performing a sealing function to each other. In such circumstances, it is naturally desireable for the zip fastening the panels not to compromise the integrity of the seal. One example of such an application is the use of a zip to fasten seat covers; another is the use of a zip to fasten a cover over a mattress where, for example, it is desired to use cover to seal the mattress against infestation by bed bugs.

The present application discloses further embodiments.

BRIEF DESCRIPTION OF DRAWINGS

Embodiments of the present invention will now be described, by way of example, and with reference to the accompanying drawings, in which.

DESCRIPTION OF PREFERRED EMBODIMENTS

Figure 1:
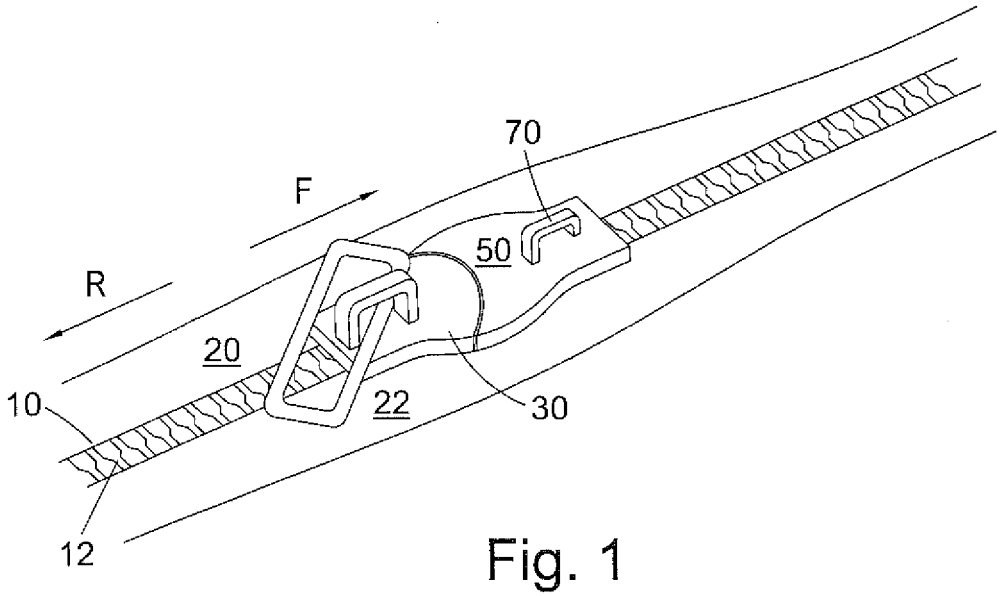
FIG. 1 is a perspective view of a zip fastener according to an embodiment of the present invention.
Figure 2:
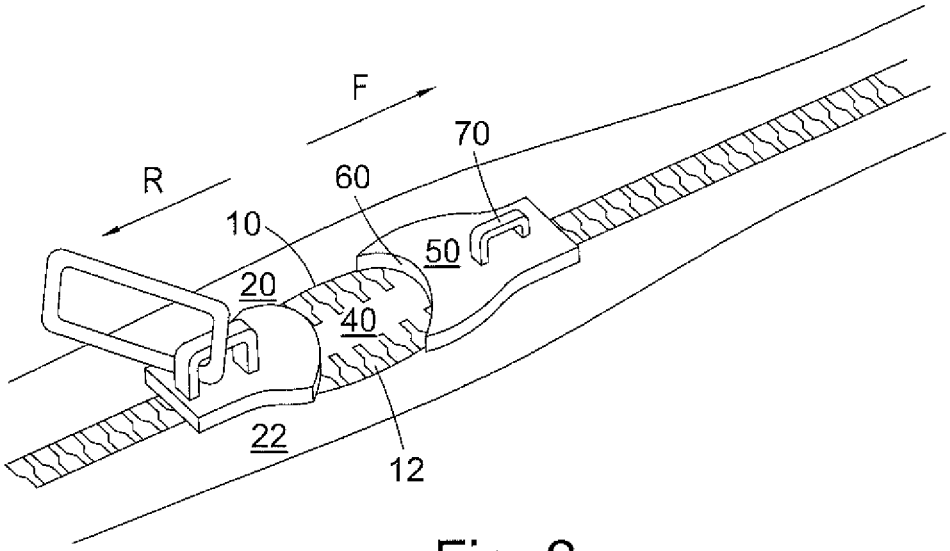
FIG. 2 is a perspective view of the zip fastener of FIG. 1 in a partly unfastened state.
Figure 3:
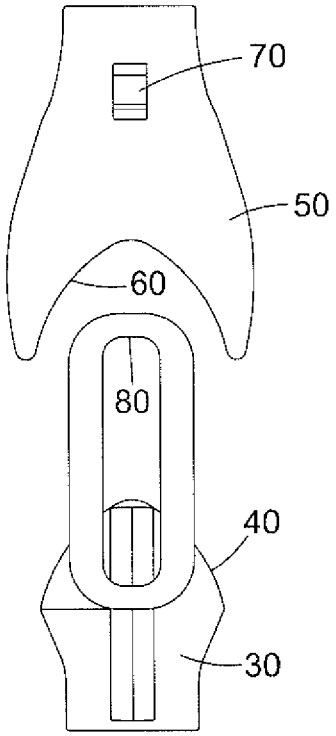
FIG. 3 is a plan view of the slider and docking member of the fastener of FIGS. 1 and 2.
Figure 4:
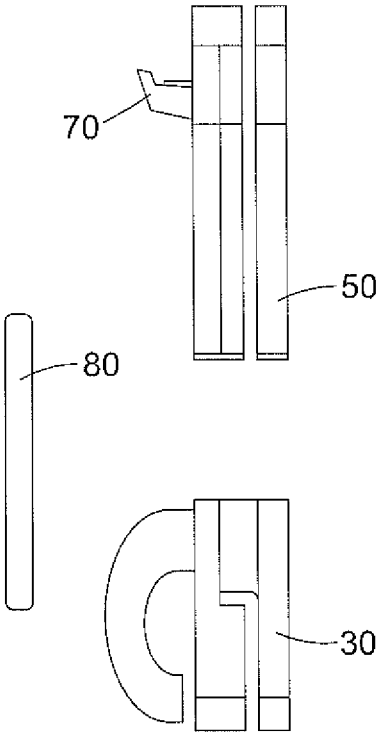
FIG. 4 is a side view of the slider and docking member of the fastener of FIG. 3.

Referring now to FIGS. 1 to 4, a zip fastener ('zip') serves to fasten together two panels of fabric (not shown). The fastener comprises two opposing and mutually engagable rows of teeth 10, 12, each of which is mounted on a stringer tape 20, 22. The fabric panels may be typically be connected to the zip by adhesion to the stringer tapes 20, 22, whether by stitching or glue or some other method. A slider 30 is mounted upon the rows of teeth 10, 12 in a manner enabling relative movement of the teeth and the slider 30 (and therefore the slider 30 and the stringer tapes 20, 22). The slider 30 is movable in a forward direction F to cause interdigitation of the teeth 10, 12, which thereby fastens the zip in a manner well known per se. Backward motion of the slider 30 in the direction indicated by the arrow R causes extradigitation of the teeth 10, 12 and thereby unfastens the zip.

In the present embodiment, the zip is adapted for use in circumstances where the panels of fabric which it fastens perform a sealing function. Accordingly it is desirable for the zip likewise to act as a seal. To this end, the zip additionally comprises a docking member 50. The front end 40 of the slider 30 is engagable with the docking member 50 to create a seal between the slider and the docking member 50. Where engagement of the front face 40 of the slider 30 and the docking member occurs when the zip is fastended along its length, the result is a sealing between the docking member 50 and slider 30 which, along with the sealing action created by the interdigitation of the fastened zip teeth 10, 12, prevents anything on one side of the two panels of fabric from passing to the other side via the zip.

In the present embodiment the docking member 50 has the form of a further slider. Accordingly, the docking member 50 is mounted to both stringer tapes 20, 22 and is engaged with the teeth 10, 12 in a manner which permits it to move along the rows of teeth 10, 12. The configuration of the further slider forming the docking member 50 is such that it is mounted in the opposite direction to the slider 30. Consequently, motion of the slider 30 and docking member 50 toward each other will cause both to fasten the zip; whilst motion away from each other will cause both to unfasten the zip. This is because motion of the docking member 50 relative to the teeth and tapes 10, 12 and 20, 22 in the direction F is a backwards motion for the docking member 50 (whereas it's a forwards and so fastening motion for the slider 30) and so unfastens the zip; whereas motion in the direction R, being a forwards motion, fastens it (the same motion for the slider 30 being a backwards, unfastening motion).

To provide sealing between the slider 30 and the docking member 50, a surface on the front 40 of the slider 30 is engagable with a correspondingly-shaped surface on the docking member. In the present embodiment, the front end 40 of the slider 30 has a curved, convex configuration. This cooperates with a correspondingly shaped curved, concave surface 60 on the docking member 50 when the two are in engagement to provide the requisite sealing. In one preferred embodiment, one of the cooperating surfaces 40, 60 of the slider 30 and docking member 50 is coated in a resilient coating to aid sealing; in a further preferred embodiment, both surfaces are thus coated. The slider 30 and docking member 50 are shown in their mutually engaged positions in FIG. 1 and disengaged positions in FIG. 2.

A locking mechanism is provided which locks the slider 30 to the docking member 50. The locking mechanism preferably includes cooperable elements on the slider 30 and docking member 50 hold them together in mutual engagement and therefore ensure maintenance of the seal when desired. In the present embodiment, the cooperable elements are provided by a hook 70 on the docking member 50—here mounted to its upper surface—and a loop 80 pivotally mounted to the slider 30 thereby to form a hasp. Preferably, as in the present embodiment, the loop 80 also serves as the pull tab for the slider 30. Preferably, as in the present embodiment, the dimension of the loop 80 and spacing of the hook 70 are such that engagement of the loop 80 with the hook 70 retains the slider 30 and docking member 50 in such a manner that force is applied by the front end 40 of the slider 30 to the rear face 60 of the docking member 50 since in this way the seal can be of high integrity. The use of one or more resilient coatings upon the front end 40 and/or rear face 60 assists this since it acts to provide firstly a degree of 'give' to accommodate engagement of the hook 70 and loop 80. Further, once the hook 70 and loop 80 are engaged, the resilient coating(s) provides a resilient reaction force which biases the hook 70 and loop 80 into secure engagement.

Figure 5A:
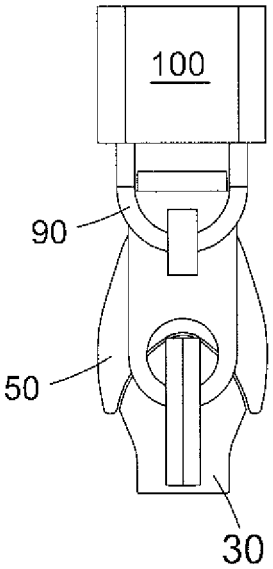
FIGS. 5A and 5B are plan and side views respectively of a modification of the slider and docking member shown in the embodiment of FIGS. 1 to 4.

Referring now to FIGS. 5A and B, in a modification of the embodiment shown in FIGS. 1 to 4, the hook 70 on the docking member 50 is formed with an aperture 72 which, when the loop 80 is engaged with it, permits a locking rod 90 to be inserted through it thereby to secure the engagement of hook 70 and loop 80. In the present illustrated example, the locking rod 90 is provided by the clasp of a padlock 100 which thereby enables a secure connection of the slider 30 and docking member 50 against unwanted disengagement.

Figure 6A:
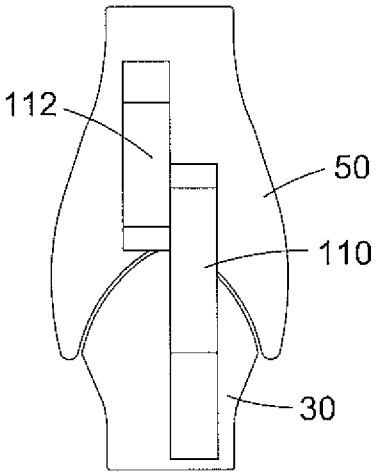
FIGS. 6A and 6B are plan and side views respectively of an alternative embodiment of slider and docking member.
Figure 6B:
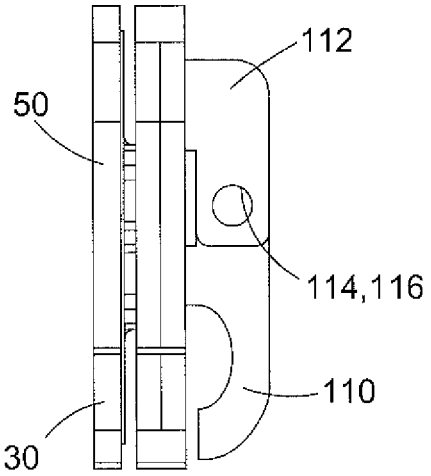
Figure 7:
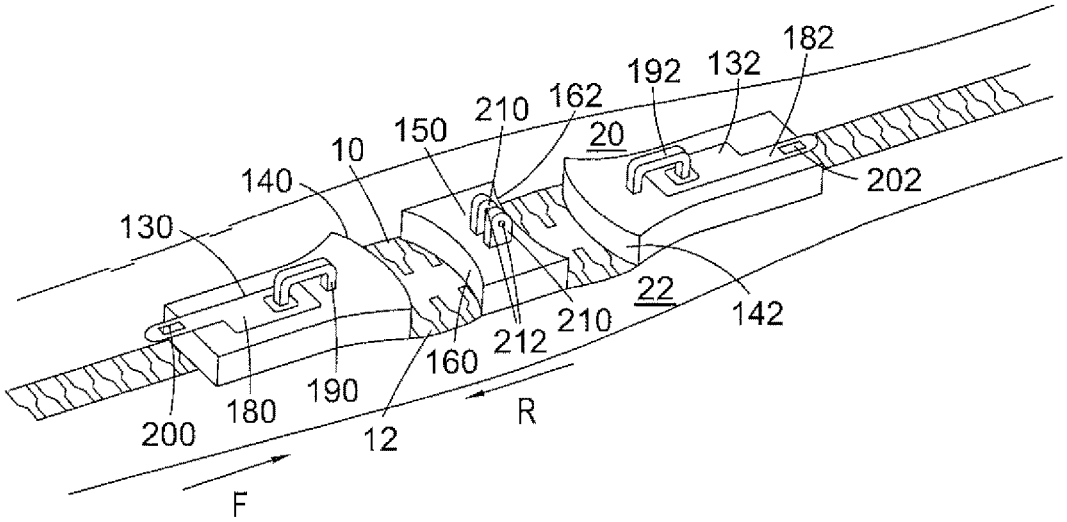
FIG. 7 is a perspective view of a further embodiment of zip fastener.

In a further modification shown in FIGS. 6A and B locking arms 110, 112 on the slider 30 and docking member 50 each have apertures 114, 116 which come into register with each other when the surfaces 40 and 60 mate thereby enabling a locking rod 90 to be inserted where desired.

Further embodiments of the invention will now be described with, where possible, like reference numerals designating like elements.

Referring now to FIGS. 7 to 10, a zip fastener comprises two opposing and mutually engagable rows of teeth 10, 12, each of which is mounted on a stringer tape 20, 22 to which the fabric panels may be typically be connected to the zip. A slider 130 is connected to the rows of teeth 10, 12 and is movable along them (and therefore relative to the stringer tapes 20, 22) in a forward direction F to cause interdigitation of the teeth 10, 12 to fasten the zip. Rearward motion of the slider in the direction indicated by the arrow R unfastens the zip. A further slider 132 is also connected to the teeth 10, 12 and operates in the same manner as the slider 30 but with an opposing action. Thus motion of the slider 132 in the direction of arrow R fastens the stringer tapes 20, 22 to each other by interdigitation of the teeth; motion in the direction F unfastening the tapes 20, 22.

In the present embodiment, the zip is adapted for use in circumstances where the panels of fabric which it fastens perform a sealing function. Accordingly it is desirable for the zip likewise to act as a seal. To this end, the zip additionally comprises a docking member 150 with which the front ends of at least one of the sliders and, more preferably the front end of each of the two sliders 130, 132 is engagable (on opposing sides of the docking member 150). The docking member 150 is mounted on the zip teeth 10, 12 and is likewise adapted for movement along the teeth 10, 12 of the stringer tapes 20, 22 at a position between the two sliders 130, 132. Thus, the docking member passes over the teeth when the teeth are not in an interdigitated state and the tapes are therefore unfastened in the region of the docking member 150. It follows that sliding motion of the docking member 150 along the zip has no interdigitating or extradigitating action on the zip teeth 10, 12 and that, accordingly, the docking member 150 is not adapted to fasten or unfasten the tapes 20, 22. The function of the docking member 150 is to engage with one or each of the sliders and, thereby, provide mutual connection of the or each of the sliders 130, 132. Preferably this is achieved in a manner which enables the zip to be used as a seal, and therefore the mutual connection provides a suitable sealing between the zip sliders 130, 132 and the docking member 150.

Thus, in the present embodiments, the front ends 140 and 142 of the sliders 130, 132 each have a curved, convex configuration and the two faces 160, 162 of the docking member 150 are correspondingly concave. This configuration provides the mutual engagability of the two sliders 130, 132 with the docking member 150 so that such engagement can seal the zip fastener. In a preferred embodiment, to provide optimal sealing between the sliders 130, 132 and the docking member 150, the front ends 140, 142 of the sliders 130, 132 are curved, convex configuration. This cooperates with a correspondingly shaped curved, concave surfaces 160, 162 on the docking member 150 when the two are in engagement to provide the requisite sealing. In one preferred embodiment, one of each of the pairs of the cooperating surfaces 140, 160 and 142, 62 is coated in a resilient coating to aid sealing; in a further preferred embodiment, both surfaces are thus coated.

As with a convention zip fastener, the sliders 130, 132 are moved along the zip by means of pull tabs 180, 182, each located on the upper face of its respective slider 130, 132 by a bridge member 190, 192. In the present embodiment, the pull tabs each have an asymmetrical configuration such that the distal end of each tab is narrower than its end proximal to the respective bridge.

Further, as with the previous embodiment, the present embodiment includes a locking mechanism actuable to lock one or, more preferably both, sliders 130, 132 to the docking member 150. Thus, each of the distal ends includes an aperture 200, 202 which is adapted to allow an upwardly extending spigot 210 located on the docking member 150 to pass through the respective aperture 200, 202 thereby to form a hasp. The spigots 210 each include an aperture 212 of their own. Accordingly, and referring now additionally to FIG. 8, when sliders 130, 132 and docking member 150 are in engagement, and the pull tabs 180, 182 are pivoted forward onto the docking member 150 so that the spigots 210 each project through the apertures 200, 202, the zip fastener may be locked in the engaged position by the passage of a suitable locking bar (not shown) through each of the apertures, thereby to retain the pull tabs in place on top of the docking member 150 and thereby prevent motion of the sliders 130, 132 away from the docking member 150.

In a modification, surfaces on the spigots 210 may be adapted to serve as a cam on the interior surfaces of the pull tab apertures 200, 202, thereby to exert a pulling force acting to urge engagement between the respective slider 130, 132 and the docking member 150.

Figure 8:
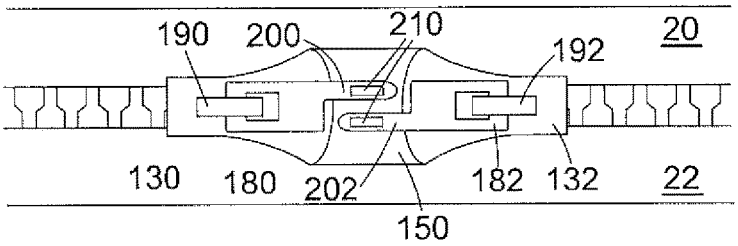
FIG. 8 is a plan view of the zip fastener of FIG. 7 in a fastened state.
Figure 9:
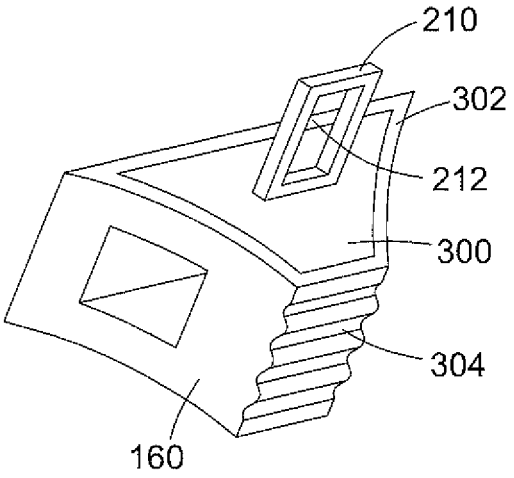
FIG. 9 is a perspective view of a part of an embodiment of docking member.

Referring now additionally to FIG. 9, the docking member may typically be constructed of two parts, each of which is trapezoidal in shape. In the embodiment of FIG. 8, each of the trapezoids is made of a central metal insert 300, typically of zinc for example, and an outer layer or jacket 302 of more resilient material, typically a suitable form of rubber. The outer layer 302 is smooth at the engagement surfaces 160, 162 of the trapezoid but its central surface 304, to assist the connection of the two trapezoids to form a single, operational docking member 150.

Figure 10:
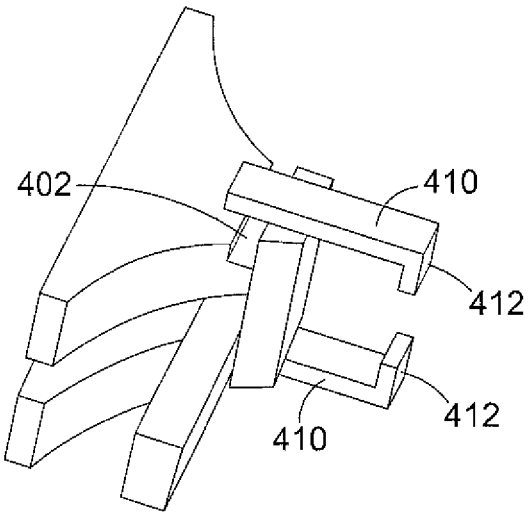
FIG. 10 is a perspective view of a part of a further embodiment of docking member.
Figure 11:
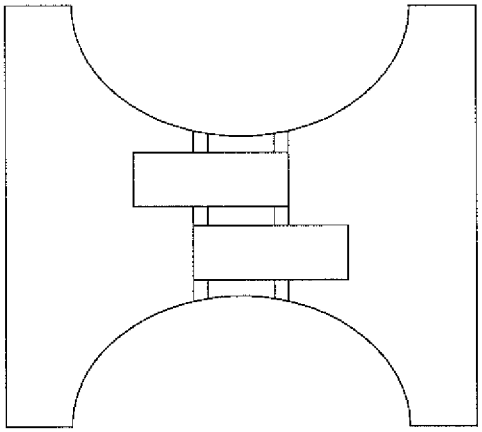
FIG. 11 is a plan view of a docking member assembled from two parts according to the embodiment of FIG. 10.

Two trapezoids may be retained or connected to each other by a configuration illustrated in FIG. 10. Each trapezoid has a ridge 402 extending longitudinally (with respect to the zip fastener) along its upper and lower surfaces and, extending from one side of the trapezoid, mutually opposing the upper and lower arms 410, the far ends of which form a pair of inwardly-depending jaws 412. Referring additionally to FIG. 11, the two trapezoids are held in mutual engagement to form a single docking member 150 by the engagement of the jaws 412 of one trapezoid projecting into and thereby engaging with the ridges 402 on the opposing trapezoid, this engagement being enabled by the lateral, mutual offset of the two sets of arms 410. Engagement of the jaws 412 in the ridges 402 occurs as a consequence of what is, in effect, an intrinsic, inwardly-directed and resilient biasing force which is created once the jaws 412 are urged slightly apart to enable them to come into register with the ridges 402. That resilient biasing force is typically (though not necessarily) a product of the elasticity of the metal or other material from which the arms 410 are constructed.

Figure 5B:
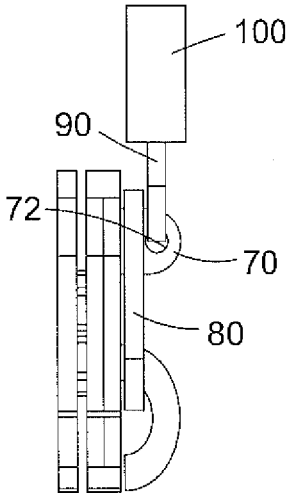
Figure 12:
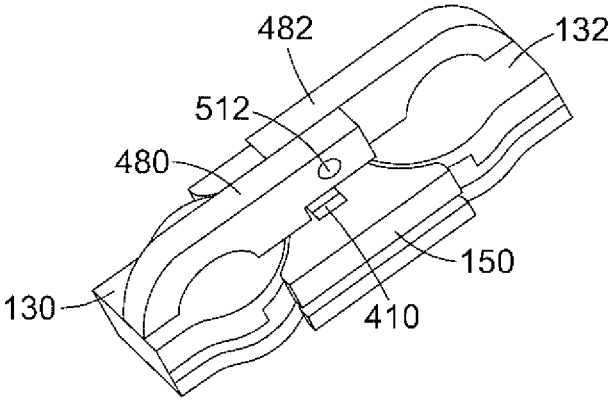
FIG. 12 is a perspective view of a further embodiment of zip fastener according to the present invention in a fastened state.

A further embodiment of zip fastener according to the present invention is illustrated in FIG. 12. As previously, the fastener comprises a pair of mutually opposing sliders 130, 132 and a docking member 150. The docking member 150 is constructed in the manner illustrated with reference to FIGS. 4 and 5, with the end of an arm 410 just visible. Each slider 130, 132 has a pull tab 480, 482, which is fixedly, rather than pivotally attached to it. Each pull tab 480, 482 projects forward of the respective slider and beyond the front face 140, 142 of that slider. Further, the location at which each of the pull tabs 480, 482 is located on its respective slider is laterally offset from the centre line. When the front faces 140, 142 of the two sliders come into engagement with the corresponding faces 160, 162 of the docking member 150, the forward ends of the pull tabs 480, 482 extend over the docking member 150. Further, the length of the pull tabs is such that their forward ends then lie adjacent each other and that laterally-extending apertures 512 in each of the forward ends of the pull tabs 480, 482 lie in register with each other. This then enables a locking member to be inserted through the two, mutually aligned apertures 512, to retain the sliders 130, 132 in engagement with the docking member 150 by means of engagement of elements on each of the sliders with each other (i.e. in the present embodiment the locking mechanism includes no element on the docking member 150 but relies on the mutual interaction of elements on the two sliders 130, 132 to hold the docking member 150 between them).

In one preferred embodiment, the locking member may be padlocked, thus enabling some security to ensure that the zip is then retained in its fastened state.

The various modifications of the present invention are not limited in their application to the embodiments in connection with which they were first described and, unless stated otherwise, each modification is applicable and has utility in connection with each of the embodiments.

The invention claimed is:

1. A zip fastener comprising:

opposing and mutually engagable rows of zip teeth each mounted upon a respective stringer tape;

a slider, movably mounted upon the teeth, being movable forwards along the teeth to cause interdigitation of the teeth thereby to fasten the zip and movable backwards to cause extradigitation and unfastening of the zip; and a docking member provided on the front of a further slider which is movably mounted upon the teeth and being movable (i) forwards along the teeth to cause interdigitation of the teeth to thereby fasten the zip and (ii) backwards to cause extradigitation and unfastening of the zip, the docking member having a surface which is engageable with a correspondingly shaped surface on the front of the slider, one of the docking member and the slider comprising a resilient surface provided by a resilient coating, the resilient surface being deformable upon engagement between the docking member and slider thereby providing a seal between the slider and the docking member, wherein the slider and further slider are mounted on the teeth in opposing directions, a corresponding motion of each of the slider and further slider thereby resulting in a corresponding action fastening/unfastening on the zip teeth, and the slider or docking member comprises a front end having a convex configuration, and the corresponding slider or docking member comprises a front end having a concave configuration.

2. A zip fastener according to claim 1 further comprising a locking mechanism provided by cooperable elements on the slider and the further slider which are actuable to lock the slider to the docking member.

3. A zip fastener according to claim 2 wherein, when the locking mechanism prevents relative motion of the slider and the further slider along the teeth when actuated to lock the slider and docking member together.

4. A zip fastener according to claim 3 wherein the locking mechanism is a hasp.

5. A zip fastener according to claim 4 wherein the hasp is provided by a loop, pivotally mounted on one of the slider and the further slider which is engageable with a hook on the other of the slider and further slider.

6. A zip fastener according to claim 5 wherein the dimension of the loop and spacing of the hook are such that engagement of the loop with the hook retains the slider and further slider in mutual engagement in such a manner that force is applied by the front end of the slider to the docking member.

7. A zip fastener according to claim 6 wherein when the hook and loop are engaged, the resilient coating provides a resilient reaction force which biases the hook and loop into secure engagement.

8. A zip fastener according to claim 5 wherein the loop is provided on a pull tab of one of the slider and further slider.

* * * * *